US007402113B2

(12) United States Patent
Mori et al.

(10) Patent No.: US 7,402,113 B2
(45) **Date of Patent: *Jul. 22, 2008**

(54) GOLF CLUB HEAD AND GOLF CLUB

(75) Inventors: Tomoaki Mori, Kanagawa (JP); Norihiko Nakahara, Kanagawa (JP); Hiroshi Saegusa, Kanagawa (JP); Yoh Nishizawa, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 186 days.

This patent is subject to a terminal disclaimer.

(21) Appl. No.: 10/537,777

(22) PCT Filed: Dec. 8, 2003

(86) PCT No.: PCT/JP03/15669

§ 371 (c)(1),
(2), (4) Date: Jun. 6, 2005

(87) PCT Pub. No.: WO2004/052472

PCT Pub. Date: Jun. 24, 2004

(65) Prior Publication Data

US 2006/0063608 A1 Mar. 23, 2006

(30) Foreign Application Priority Data

Dec. 6, 2002 (JP) ..... 2002-355874

(51) Int. Cl.
*A63B 53/04* (2006.01)

(52) U.S. Cl. ..... 473/348; 473/345

(58) Field of Classification Search ..... 473/324–350
See application file for complete search history.

(56) References Cited

U.S. PATENT DOCUMENTS 6,248,025 B1 6/2001 Murphy et al.
6,969,326 B2 * 11/2005 De Shiell et al. ..... 473/345

FOREIGN PATENT DOCUMENTS

| | | |
|---|---|---|
| JP | 4-89071 | 3/1992 |
| JP | 7-112041 | 5/1995 |
| JP | 07-112042 | 5/1995 |
| JP | 07-128411 | 5/1995 |
| JP | 09-070455 | 3/1997 |

(Continued)

*Primary Examiner*—Alvin A Hunter
(74) *Attorney, Agent, or Firm*—Finnegan, Henderson, Farabow, Garrett & Dunner, L.L.P.

(57) ABSTRACT

A golf club head and a golf club provided with the golf club head. The head has outer shell structure portions including a hosel portion, a face portion, a sole portion, a crown portion, and a side portion and a joining portion where a crown member used in the crown portion is bonded to a member used in another outer shell structure portion. The member to be used as the crown member has an equivalent rigidity not more than 0.8 times as high as that of a sole member used in the sole portion where the equivalent rigidity of a member used in any one of the outer shell structure portions is defined as the product of the thickness of the relevant member and the elastic modulus of the member in a direction in which a golf ball-striking surface of the face portion is oriented.

11 Claims, 10 Drawing Sheets

FOREIGN PATENT DOCUMENTS

| | | |
|---|---|---|
| JP | 11-290488 | 10/1999 |
| JP | 2001-190719 | 7/2001 |
| JP | 2002-186691 | 7/2002 |
| JP | 2002-315855 | 10/2002 |
| JP | 2003-275344 | 9/2003 |
| JP | 2003-320060 | 11/2003 |
| WO | WO 93/00968 | 1/1993 |

* cited by examiner

GOLF CLUB HEAD AND GOLF CLUB

TECHNICAL FIELD

The present invention relates to a golf club head of a wood type and a golf club. More specifically, the present invention relates to a golf club head comprising two or more members and to a golf club which has such a golf club head.

PRIOR ART

Wood type hollow golf club heads manufactured from metals are known conventionally as golf club heads. Those wood type golf club heads have a large volume, allowing an increase in a face area to form a large sweet spot. Consequently, there is a trend at present to provide golf club heads having even larger volume. On the other hand, the weight of the golf club head increases as the golf club head is made larger, and it becomes difficult to swing through the shot when making a golf swing. It therefore becomes necessary to make the golf club head lighter in weight. In order to satisfy the contrary demands for higher volume and lighter weight, hollow wood type metal golf club heads manufactured by using a light metal, such as titanium or a titanium alloy, have been proposed (refer to JP 2002-186691 A and JP 2002-315855 A, for example).

Hollow wood type golf club heads made using this type of light metal satisfy the contradictory requirements for large volume and light weight. However, the cost of the material itself is high with specialty metals such as titanium and titanium alloys, and therefore there is a problem in that the cost of the golf club head becomes high. In addition, there is also a problem in that limitations are imposed on the workability and the degree of freedom of design such as changing of the material to be used depending on the portion of the golf club head.

A golf club head that uses a composite material other than light metals has therefore been proposed (refer to JP 2001-190719 A and JP 11-290488 A, for example). In JP 2001-190719 A, a golf club head made from a composite material is manufactured by seating a composite material prepreg sheet within a molding die. Further, in JP 11-290488 A, a metal matrix composite material, in which long fibers are laminated on a metal matrix, is formed and used in a face surface.

However, there are problems with an integral formation method in which a composite material prepreg sheet is seated within a molding die, as in JP 2001-190719 A, in that manufacturing is troublesome and processes involved in manufacturing become complex. In addition, there is also a problem in that sufficient restitution characteristics cannot be obtained.

On the other hand, with a method of joining by welding as in JP 11-290488 A, there is a problem in that sufficient restitution characteristics and durability cannot be obtained. In addition, there is also a problem in that welding cannot be performed for cases where members that are formed by using different types of metals are joined. It becomes necessary to join the members by mechanical fastening, and this leads to cost increases.

The present invention has been made in order to solve conventional problems like those described above. An object of the present invention is to provide a golf club head which has high levels of restitution characteristics and durability, with good balance between the restitution characteristics and the durability, and moreover which can be manufactured at low cost and to provide a golf club which has such a golf club head.

DISCLOSURE OF THE INVENTION

Figure 1:
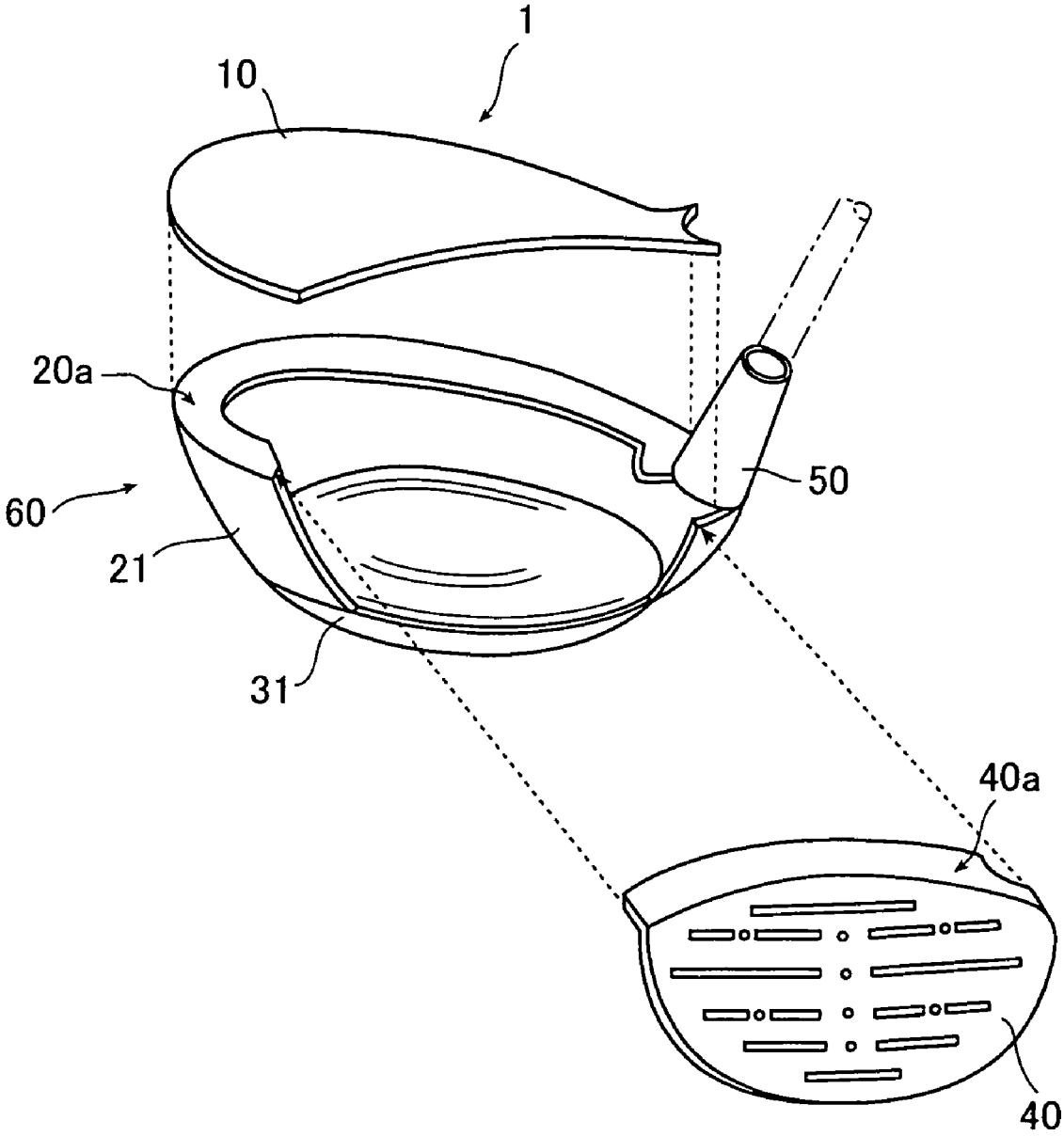
FIG. 1 is an exploded perspective view of a golf club head of the present invention.

The present invention provides a golf club head comprising outer shell structure portions including a hosel portion, a face portion, a sole portion, a crown portion, and a side portion; and a joining portion where a crown member used in the crown portion is bonded to a member used in another outer shell structure portion, wherein: the crown member has an equivalent rigidity not more than 0.8 times as high as that of a sole member used in the sole portion where the equivalent rigidity of a member used in each portion is defined as the product of the thickness of the relevant member and the elastic modulus of the member in a direction in which a golf ball-striking surface of the face portion is oriented.

The crown member whose equivalent rigidity is to be found is a member used in a region of the crown portion, which region is located along the connecting edge of the crown portion connecting to the face portion and within a distance of 50 mm from the connecting edge and whose surface area constitutes 5% or more of the total surface area of the crown portion. The sole member whose equivalent rigidity is to be found is a member used in a region of the sole portion, which region is located along the connecting edge of the sole portion connecting to the face portion and within a distance of 50 mm from the connecting edge and whose surface area constitutes 5% or more of the total surface area of the sole portion.

It is preferred that the members joined together in the joining portion are formed of a different material from one member to another. It is also preferred that the members joined together in the joining portion are each formed of a material selected from the group consisting of a metal, a fiber reinforced metal (FRM), a metal matrix composite (MMC), a fiber reinforced plastic (FRP), and a ceramic matrix composite (CMC). In that case, the crown member is formed of a fiber reinforced plastic (FRP), for instance.

The present invention also provides a golf club head comprising outer shell structure portions including a hosel portion, a face portion, a sole portion, a crown portion, and a side portion; and a joining portion where a crown member used in the crown portion is bonded to a member used in another outer shell structure portion, wherein: the crown member is composed of a plurality of laminated layers of a fiber reinforced material, of which layers two or more have a fiber orientation angle of 45 to 90 degrees with respect to a direction in which a golf ball-striking surface of the face portion is oriented, and the number of the layers having a fiber orientation angle of 45 to 90 degrees with respect to the direction in which the striking surface is oriented constitutes 50 percent or more of the total number of the laminated layers.

The present invention also provides a golf club head comprising outer shell structure portions including a hosel portion, a face portion, a sole portion, a crown portion, and a side portion; and a joining portion where a crown member used in the crown portion is bonded to a member used in another outer shell structure portion, wherein: the crown member is composed of a plurality of laminated layers of a fiber reinforced material, of which layers two or more have a fiber orientation angle of 45 to 90 degrees with respect to a direction in which a golf ball-striking surface of the face portion is oriented, and the mass of reinforcing fibers in the layers having a fiber orientation angle of 45 to 90 degrees with respect to the direction in which the striking surface is oriented constitutes 50 percent or more of the mass of reinforcing fibers in all the laminated layers.

As for the above "fiber orientation angle of 45 to 90 degrees", the fiber orientation angle is represented in absolute values. To be more specific, a fiber orientation angle of 45 to 90 degrees is actually within a range of −45 to −90 degrees or a range of +45 to +90 degrees with respect to the direction in which the striking surface is oriented. Preferably, the fiber orientation angle is 45 degrees or more and, at the same time, less than 90 degrees. Among such angles, angles of +45 degrees and −45 degrees are included but those of +90 degrees and −90 degrees are not included.

The crown member may also be composed of a material in the form of a fabric-like cross prepreg in which reinforcing fibers are oriented in two different directions, that is to say, at two different orientation angles of, for instance, −45 degrees and +45 degrees.

Preferably, the crown member has an equivalent rigidity not more than 0.8 times as high as that of a sole member used in the sole portion where the equivalent rigidity of a member used in each portion is defined as the product of the thickness of the relevant member and the elastic modulus of the member in the direction in which the golf ball-striking surface of the face portion is oriented.

Moreover, the crown member is formed preferably of either a fiber reinforced metal (FRM) or a fiber reinforced plastic (FRP).

Preferably, the two or more layers having a fiber orientation angle of 45 to 90 degrees with respect to the direction in which the striking surface is oriented constitute crossover layers in which reinforcing fibers are slanted from the direction in which the striking surface is oriented to a direction different from one layer to another. The preferred crossover angle of the reinforcing fibers is around a right angle (from 85 to 95 degrees).

The present invention also provides a golf club head comprising outer shell structure portions including a hosel portion, a face portion, a sole portion, a crown portion, and a side portion; and a joining portion where a crown member used in the crown portion is bonded to a member used in another outer shell structure portion, wherein: the crown member is composed of a plurality of laminated layers of a fiber reinforced material, of which layers two or more have a fiber orientation angle of 45 to 90 degrees with respect to a direction in which a golf ball-striking surface of the face portion is oriented, and the crown member has an equivalent rigidity not more than 0.8 times as high as that of a sole member used in the sole portion where the equivalent rigidity of a member used in each portion is defined as the product of the thickness of the relevant member and the elastic modulus of the member in the direction in which the golf ball-striking surface of the face portion is oriented.

Furthermore, the present invention provides a golf club having a golf club head, a golf club shaft, and a grip, wherein: the golf club head comprises outer shell structure portions including a hosel portion, a face portion, a sole portion, a crown portion, and a side portion; and a joining portion where a crown member used in the crown portion is bonded to a member used in another outer shell structure portion; and the crown member is composed of a plurality of laminated layers of a fiber reinforced material, of which layers two or more have a fiber orientation angle of 45 to 90 degrees with respect to a direction in which a golf ball-striking surface of the face portion is oriented, and in the crown member, for instance, the number of the layers having a fiber orientation angle of 45 to 90 degrees with respect to the direction in which the striking surface is oriented constitutes 50 percent or more of the total number of the laminated layers.

Finally, the present invention provides a golf club having a golf club head, a golf club shaft, and a grip, wherein: the golf club head comprises outer shell structure portions including a hosel portion, a face portion, a sole portion, a crown portion, and a side portion; and a joining portion where a crown member used in the crown portion is bonded to a member used in another outer shell structure portion; and the crown member is composed of a plurality of laminated layers of a fiber reinforced material, of which layers two or more have a fiber orientation angle of 45 to 90 degrees with respect to a direction in which a golf ball-striking surface of the face portion is oriented, and in the crown member, the mass of reinforcing fibers in the layers having a fiber orientation angle of 45 to 90 degrees with respect to the direction in which the striking surface is oriented constitutes 50 percent or more of the mass of reinforcing fibers in all the laminated layers.

BEST MODE FOR IMPLEMENTING THE INVENTION

Figure 2:
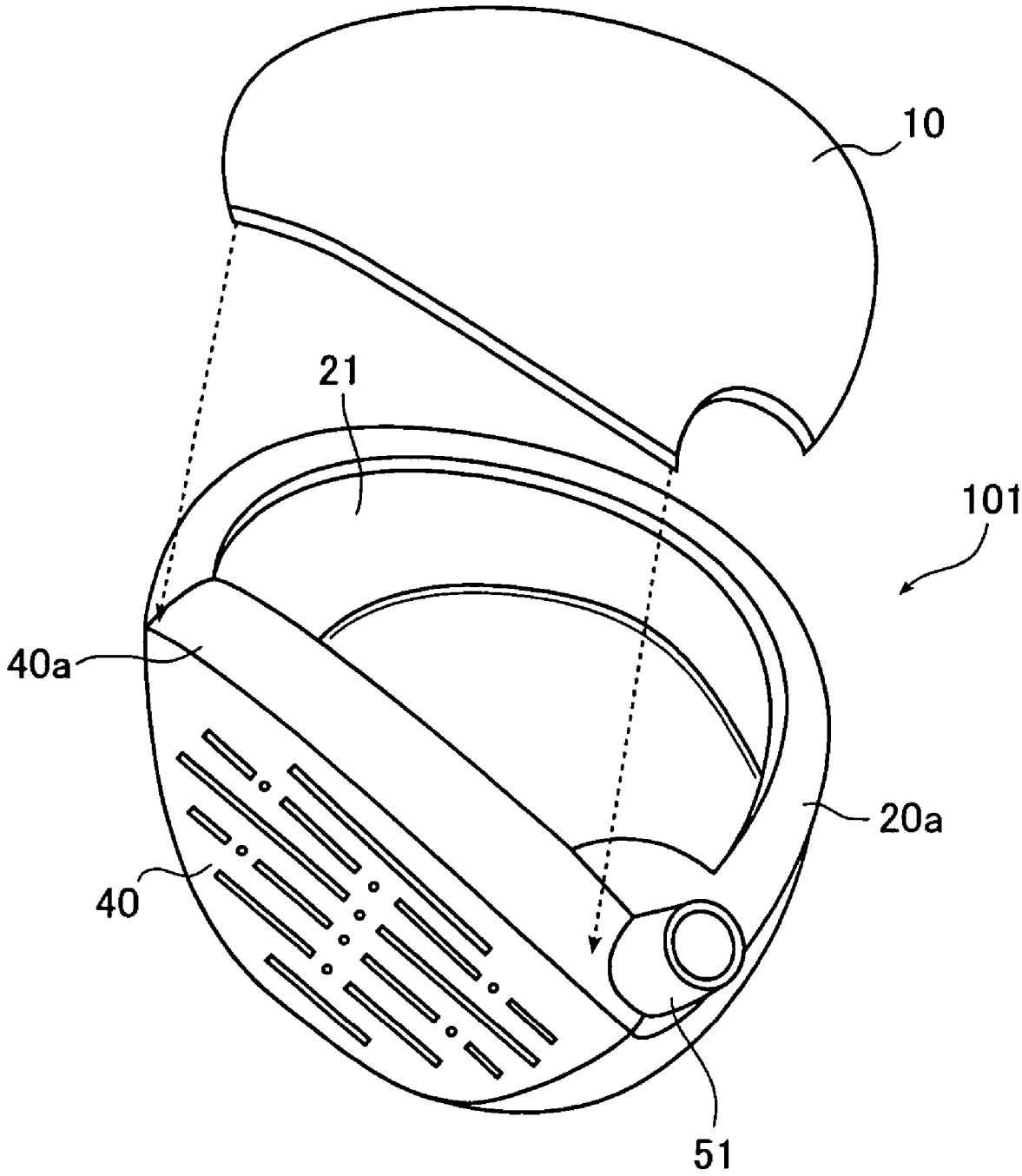
FIG. 2 is an exploded perspective view of the golf club head of the present invention.
Figure 3A:
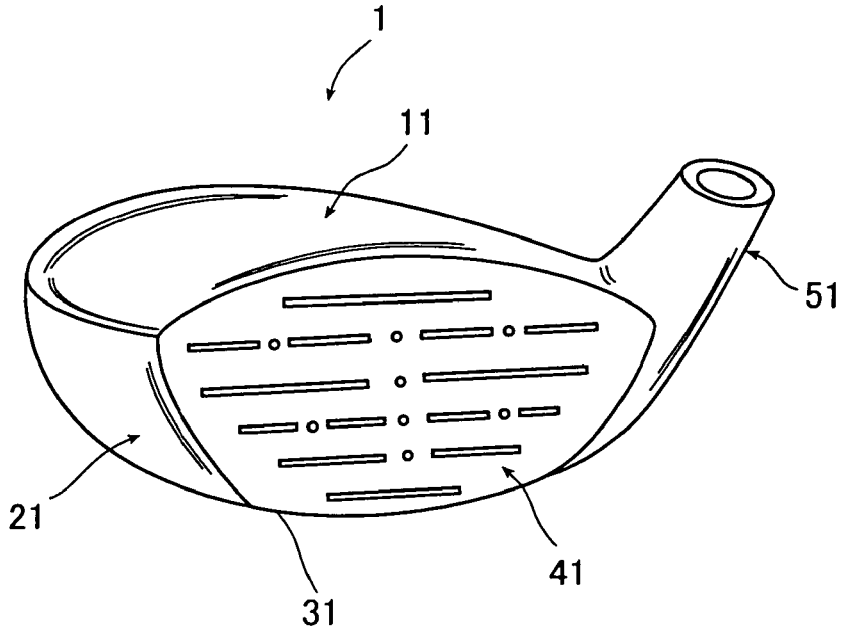
FIG. 3A is a perspective view of the golf club head of the present invention and FIG. 3B is a perspective view of the golf club which has the golf club head as shown in FIG. 3A.
Figure 3B:
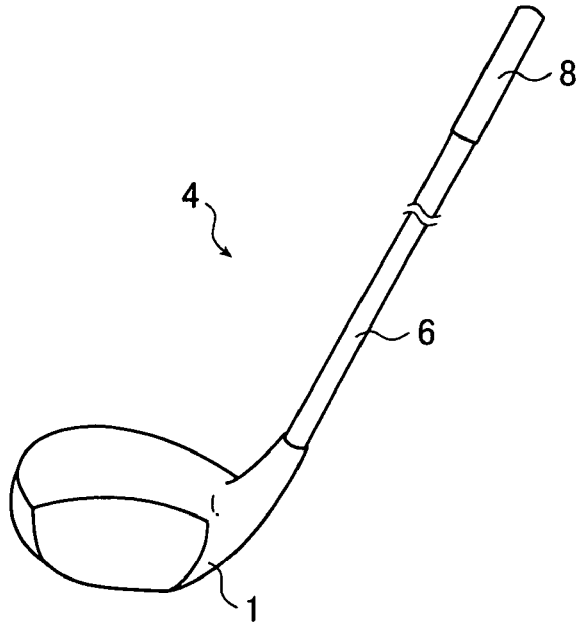

A golf club head and a golf club according to the embodiments of the present invention are described below. FIG. 1 and FIG. 2 are exploded perspective views of a golf club head 1 of the present invention, as well as FIG. 3A is a perspective view of the golf club head 1 of the present invention and FIG. 3B is a perspective view of the golf club 4 of the present invention which has the golf club head 1. As shown in FIG. 3A, the golf club head 1 of the present invention is a hollow golf club head which is provided with a crown portion 11, a side portion 21, a sole portion 31, a hosel portion 51, and a face portion 41 as outer shell structure portions.

As shown in FIG. 3B, the golf club 4 has the golf club head 1, a golf club shaft 6 and a grip 8. The golf club head 1 is provided on one end of the golf club shaft 6 and the grip 8 is provided on the other end of the golf club shaft 6.

Figure 4A:
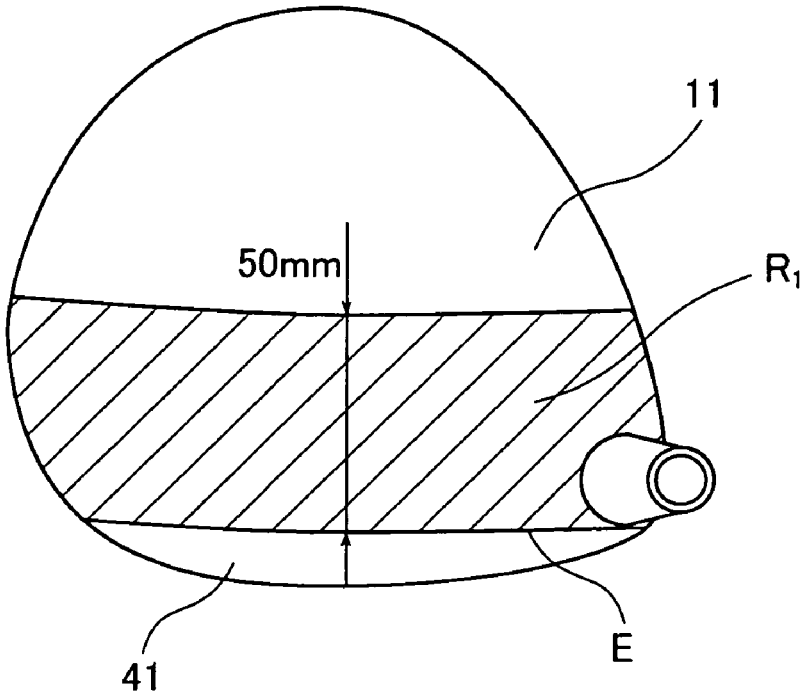
FIGS. 4A and 4B are diagrams explaining a crown member of the golf club head of the present invention.
Figure 4B:
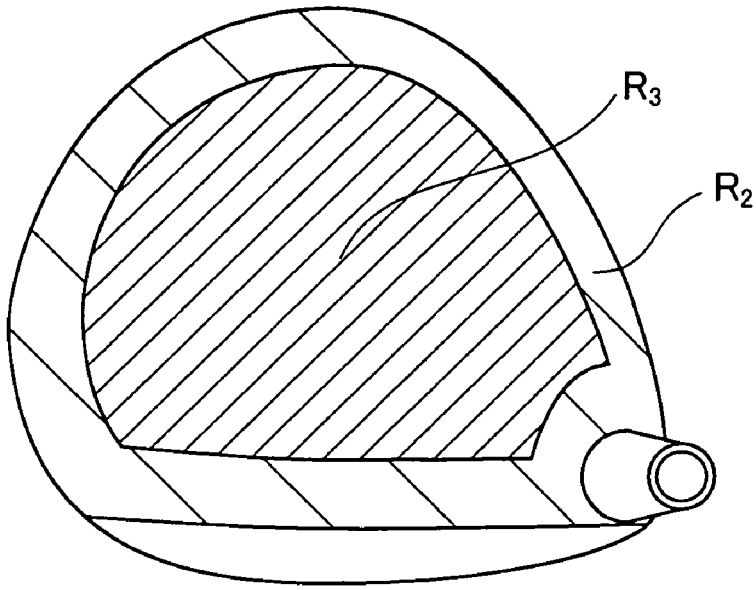

Structural elements used in the outer shell structure portions of the golf club head 1 are herein referred to as members. For example, a structural element that forms the crown portion 11 is referred to as a crown member for cases where the crown portion 11 is formed by using a discrete structural element. Similarly, a structural element that forms the face portion 41 is referred to as a face member, and a structural element that forms the sole portion is referred to as a sole member. However, for cases where the side portion 21 and the sole portion 31 are formed by integral molding, for example, the term "sole member" refers to a portion of the integrally molded structural element which corresponds to the sole portion 31. Furthermore, structural elements added later are not included among the members. By the way, the crown member available for obtaining the equivalent rigidity ratio as described below is the member used in any of the regions (regions $R_1$, $R_2$ and $R_3$) as shown in FIGS. 4A and 4B with hatching. Such a configuration will be described below.

As shown in FIG. 1, among the crown portion 11, the side portion 21, the sole portion 31, the hosel portion 51, and the face portion 41, the crown portion 11 and the face portion 41 are formed by one discrete crown member 10 and one discrete face member 40, respectively. On the other hand, the side portion 21, the sole portion 31, and the hosel portion 31 are formed collectively by a golf club head main body 60 as integrally molded. The crown member 10, the face member 40, and the golf club head main body 60 are separate outer shell constituting members, each as a component of a hollow golf club head. The golf club head 1 is made up by joining these outer shell constituting members together.

The face member 40 and the golf club head main body 60 are formed of a metal, for example, titanium or a titanium alloy, while the crown member 10 is formed of a carbon fiber reinforced plastic (CFRP). The crown member 10 is made by laminating carbon fibers as reinforcing fibers in, for example, 3 to 7 layers, with the orientation angle of them being shifted from one layer to another within a range of 45 to 90 degrees with respect to the direction in which the striking surface is oriented, impregnating the laminate thus obtained with an epoxy resin and so forth and then drying it to obtain a prepreg, cutting the prepreg after the contour of the development of the crown portion 11, and molding the cut prepreg into the form of the crown portion 11, and then curing it. In consequence, the crown member 10 is curved approximately into a shape of part of a spherical surface, as shown in FIG. 1 and FIG. 2. There are no particular limitations placed on the thickness of the crown member 10, and any thickness may be used at which a strength capable of withstanding impacts during ball striking can be maintained. The preferred thickness of the crown member 10 is typically from 0.3 to 2.0 mm. There are no particular limitations placed on the mass of the crown member 10, but it is preferable that the mass of the crown member 10 be at 3 to 10% of the mass of the overall golf club head 1.

When the equivalent crown rigidity is defined as the product of the elastic modulus (Young's modulus) of the crown member 10 in the direction in which the golf ball-striking surface of the face portion 41 is oriented and the thickness of the crown member 10 and the equivalent sole rigidity is defined as the product of the elastic modulus of the sole portion 31 in the direction in which the golf ball-striking surface of the face portion 41 is oriented and the thickness of the sole portion 31, the equivalent crown rigidity is made not more than 0.8 times as high as the equivalent sole rigidity.

The elastic modulus as referred to above is defined as follows on condition that the golf club head 1 is addressed in an ordinary position on the horizontal reference plane.

Supposing that there is the plane extending in the direction in which the striking surface of the face portion is oriented when the golf club head 1 is addressed in an ordinary position on the horizontal reference plane, that is perpendicular to both the reference plane and the striking surface, the above elastic modulus is the elastic modulus whose values are obtained in the direction in which the line of intersection of the plane as supposed above and the crown portion lies.

The direction in which the striking surface is oriented as referred to above should be considered as the azimuthal direction which is an oriented direction of the striking surface in a plane parallel to the reference plane when the golf club head 1 addressed in an ordinary position is looked down on perpendicularly to the reference plane. The expression "addressed in an ordinary position" used herein means that the golf club head 1 is addressed in accordance with the lie angle, with the central axis of the golf club shaft and the leading edge of the face portion of the golf club head being found to be parallel to each other when the golf club is looked down on perpendicularly to the reference plane, that is to say, with the face angle being zero. The expression "addressed in accordance with the lie angle" used herein means to be addressed such that the gap between the round surface of the sole portion as the bottom surface of the golf club head and the reference plane does not essentially vary from the toe side to the heel side. If the round surface of the sole portion is indefinite, the golf club may be addressed such that the score lines made on the striking surface are parallel to the reference plane. If the round surface of the sole portion is indefinite and, in addition, the score lines are hard to determine whether or not to be parallel to the reference plane because of their being not straight lines, and so forth, the lie angle is set using the equation: the lie angle (degrees)=(100−the club length (inches)). In the case of the club length of 44 inches, for instance, the lie angle is 100−44=56 degrees.

The club length is measured by the mensuration established by Japan Golf Goods Association. Examples of the measuring instrument to be used include Club Measure II manufactured by Kamoshita Seikoujyo Corporation.

The ratio of the equivalent crown rigidity to the equivalent sole rigidity (the equivalent rigidity ratio), namely the equivalent sole rigidity/equivalent crown rigidity ratio, obtained under such definitions as above may have a value of equal to or less than 0.8 in order to effectively change the initial ballistic characteristics of the golf ball, as described hereinafter. By thus setting the equivalent crown rigidity to be not more than 0.8 times as high as the equivalent sole rigidity, the backspin rate of a golf ball when the golf ball is struck with the striking surface can be reduced, and the launch angle can be increased.

Figure 5A:
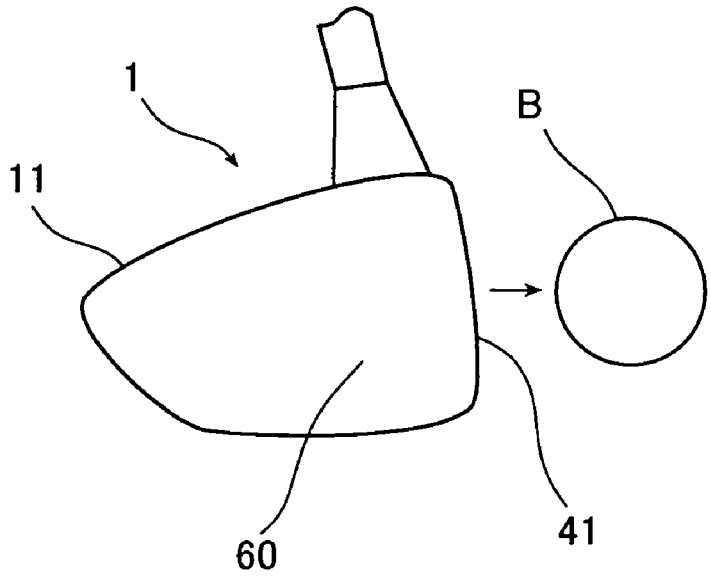
FIGS. 5A and 5B are diagrams clearly explaining the deformation caused when a golf ball is struck with the golf club.
Figure 5B:
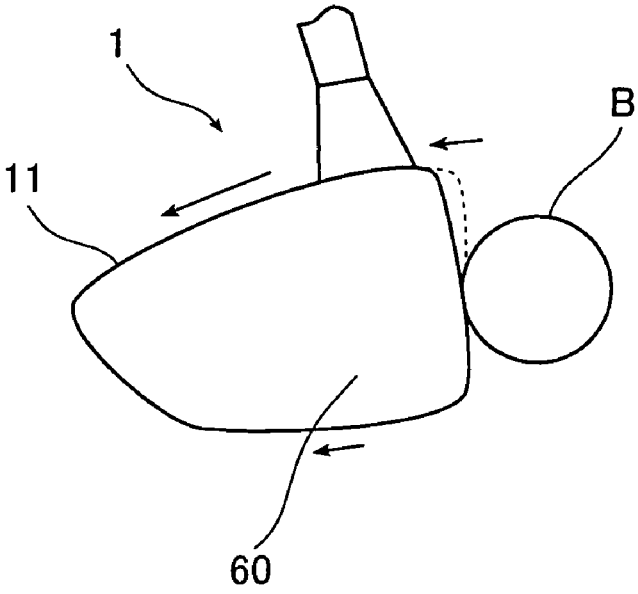

FIGS. 5A and 5B are explanatory diagrams for explaining, in an easy to understand manner, how a golf ball is struck with a golf club. As shown in FIG. 5A, when a golf ball B is struck, an impact force of the golf ball acts on the striking surface of the face portion 41, and the impact force is transmitted to the crown portion and the sole portion. Now, directing attention to shearing deformations of the crown portion and the sole portion that are generated due to the impact force, the equivalent crown rigidity is not more than 0.8 times as high as the equivalent sole rigidity, and the shearing deformation of the crown portion therefore becomes larger than the shearing deformation of the sole portion. The striking surface of the face portion 41 therefore deforms slightly in such a direction as realizing a larger loft angle. This deformation of the striking surface when impacted by the golf ball affects the backspin rate of the golf ball and the launch angle of the golf ball.

Figure 6A:
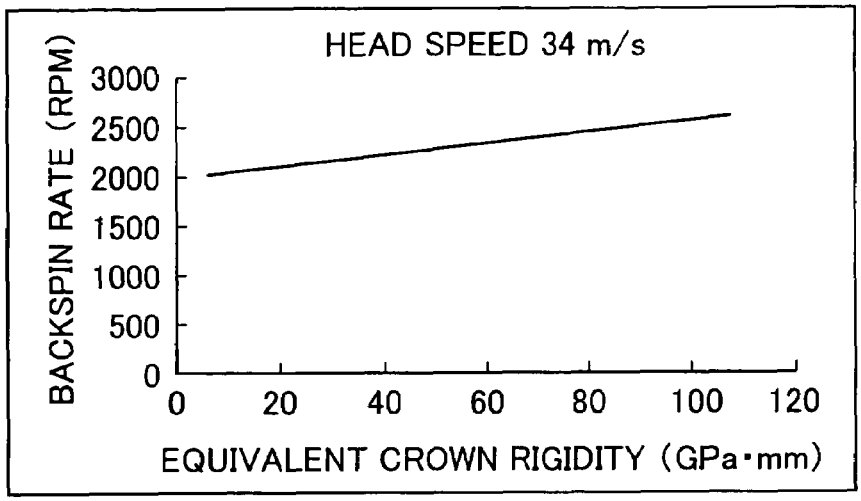
FIGS. 6A to 6C are diagrams that show changes in the backspin rate of a golf ball with respect to changes in equivalent crown rigidity.
Figure 6B:
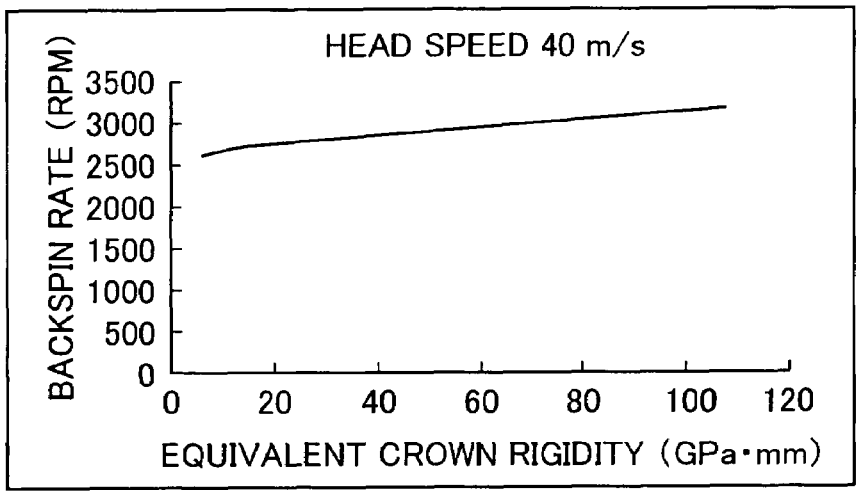
Figure 6C:
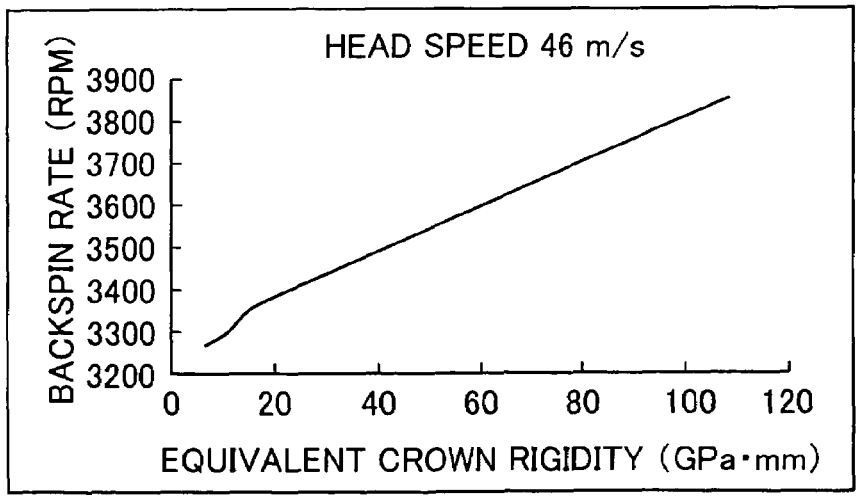

FIGS. 6A to 6C show changes in the backspin rate for cases where the equivalent crown rigidity is changed while keeping the equivalent sole rigidity (113 GPa·mm) fixed, for head speeds of 34 m/s, 40 m/s, and 46 m/s. As shown in FIGS. 6A to 6C, although the amount of change differs according to the head speed, it can be understood that the backspin rate decreases due to the reduction in the equivalent crown rigidity in each of the cases.

Figure 7A:
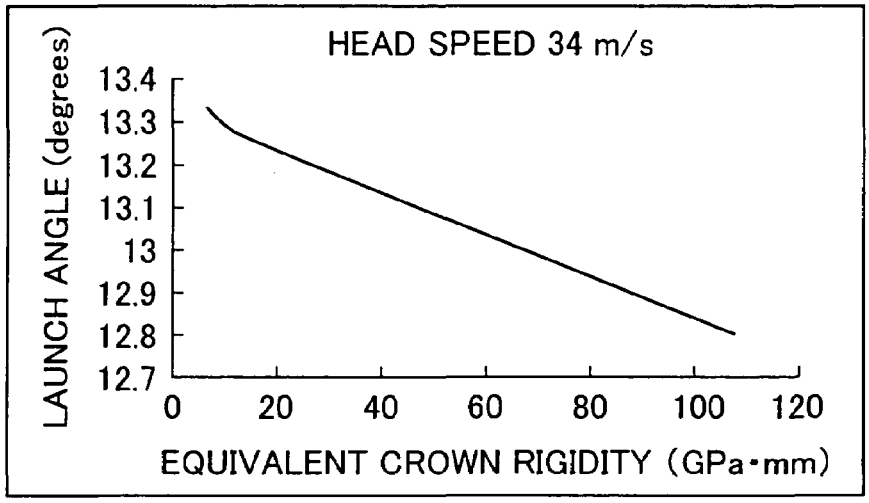
FIGS. 7A to 7C are diagrams that show changes in the launch angle of a golf ball with respect to changes in equivalent crown rigidity.
Figure 7B:
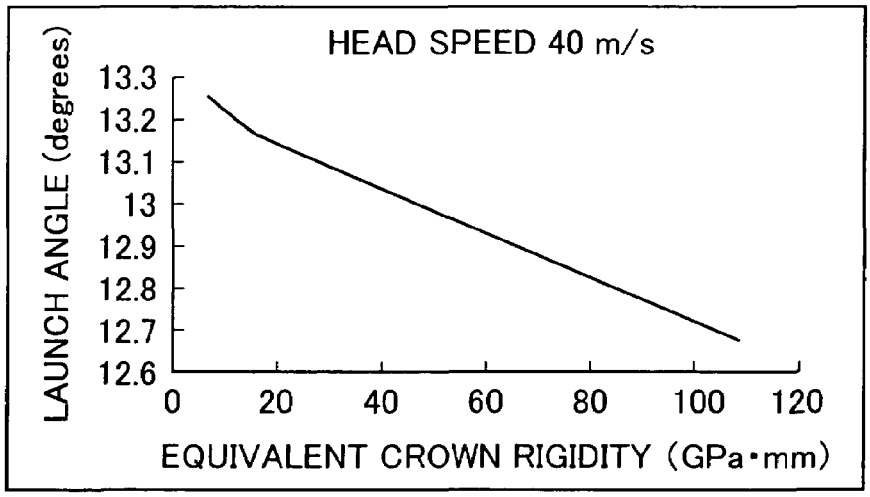
Figure 7C:
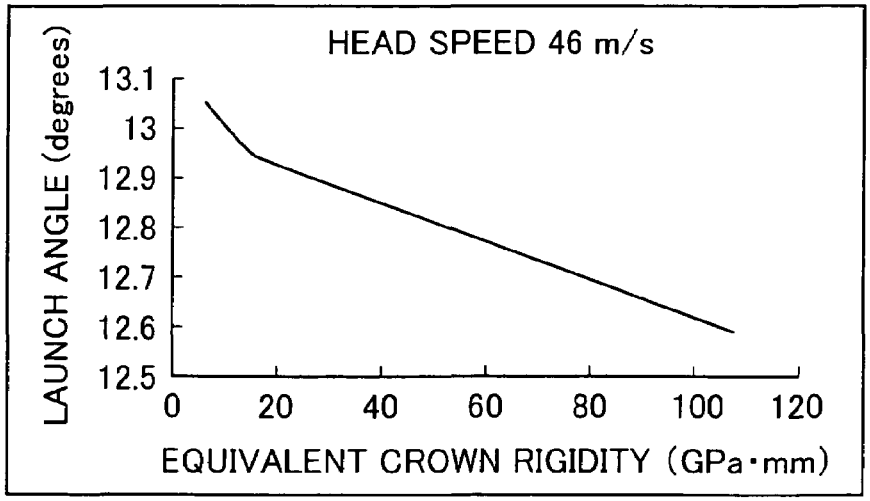

On the other hand, FIGS. 7A to 7C show changes in the launch angle for cases where the equivalent crown rigidity is changed while keeping the equivalent sole rigidity (113 GPa·mm) fixed, for head speeds of 34 m/s, 40 m/s, and 46 m/s. As shown in FIGS. 7A to 7C, although the amount of change differs according to the head speed, it can be understood that the launch angle increases due to the reduction in the equivalent crown rigidity in each of the cases.

Figure 8A:
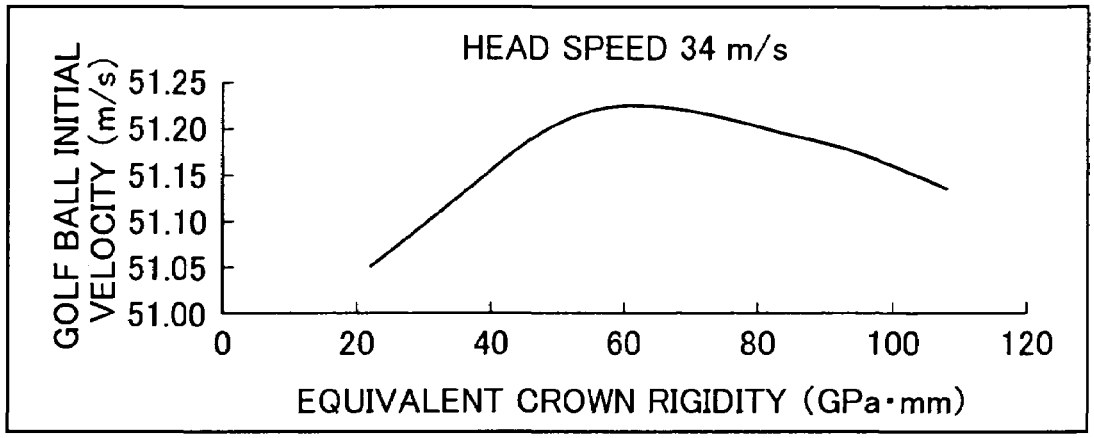
FIGS. 8A to 8C are diagrams that show changes in the initial velocity of a golf ball with respect to changes in equivalent crown rigidity.
Figure 8B:
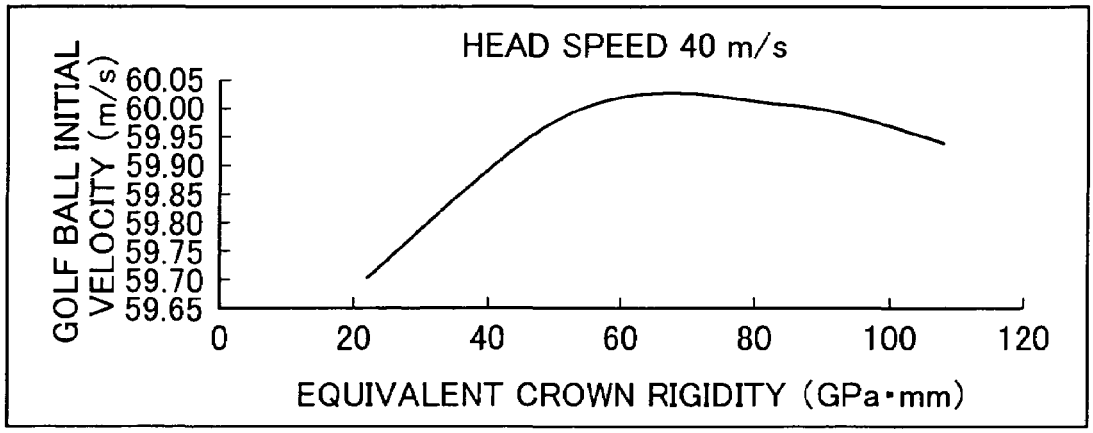
Figure 8C:
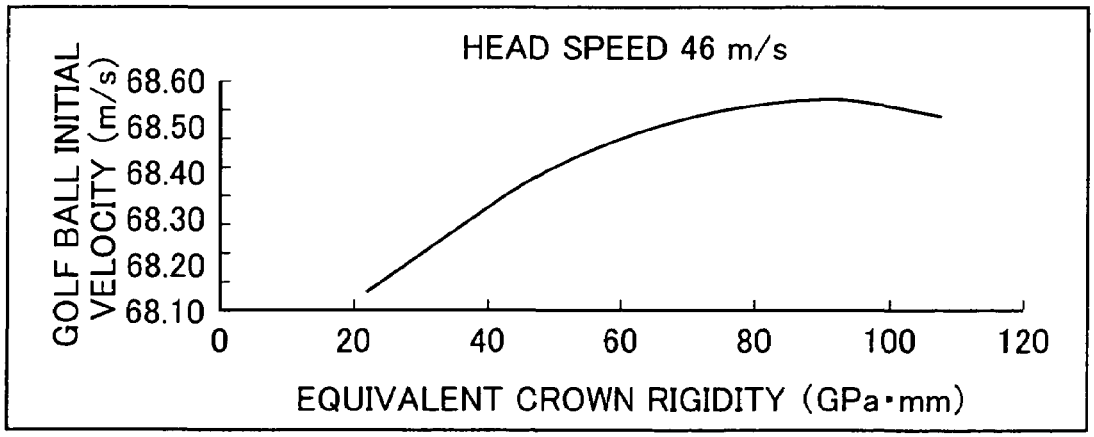

Further, FIGS. 8A to 8C show changes in the initial velocity of a golf ball for cases where the equivalent crown rigidity is changed while keeping the equivalent sole rigidity (113 GPa·mm) fixed, for head speeds of 34 m/s, 40 m/s, and 46 m/s. As shown in FIGS. 8A to 8C, it can be understood that, in each of the cases, there exists a value of the equivalent crown rigidity at which the initial velocity of a golf ball becomes the maximum.

In order to realize the member whose equivalent crown rigidity is as above, it is suitable to employ a composite material comprising a fiber reinforced plastic (FRP) material, such as a carbon fiber reinforced plastic (CFRP) material having carbon fibers incorporated therein as reinforcing fibers. The composite material may be so fabricated as to have 7 or 3 layers as set forth in Table 1 below, for instance, and can have an equivalent rigidity of any value from 0.37 to 5.63 times as large as the reference value. In this respect, the reference value is a value of the equivalent rigidity of a five layer composite material obtained by laminating 4 layers of carbon fiber reinforced plastic material, with the orientation angle of them being set alternately to +45 degrees and −45 degrees with respect to the predetermined reference direction, and piling the uppermost layer of carbon fiber reinforced plastic material having an orientation angle of 90 degrees with respect to the predetermined reference direction onto the laminate formed. As for the reference direction, the striking surface of a golf club head is oriented in a specified direction (azimuthal direction) when the golf club head is addressed in an ordinary position on the reference plane, and such direction (azimuthal direction) is to be considered as the reference direction. Since the crown member is curved, the reference direction may be defined more specifically as the direction in which lies the line of intersection of the crown member on one hand and the plane which is perpendicular to the reference plane and extends in the oriented direction of the striking surface on the other, and the crown member on the other. Hereafter, the orientation angle is understood to be set with respect to the reference direction as described above.

Referring now to Table 1, the member composed of 3 laminated layers each having an orientation angle of 0° or 90°, for instance, is formed such that the layers have orientation angles of 90°, 0°, and 90°, from the lowermost to the uppermost layers sequentially. The member composed of 7 laminated layers each having an orientation angle of +60°, −60° or 90° is formed such that the layers have orientation angles of +60°, −60°, +60°, −60°, +60°, −60°, and 90°, from the lowermost to the uppermost layers sequentially. Graphs shown in FIGS. 6A to 6C, 7A to 7C, and 8A to 8C can be obtained by manufacturing the golf club head 1 by using such a composite material as set forth in the table in the crown member 10, and performing golf ball striking tests to measure the initial ballistic characteristics of a golf ball.

TABLE 1

| Number of laminated layers | Thickness | Equivalent crown rigidity value: Orientation angle 0°, 90° | Orientation angle ±30°, 90° | Orientation angle ±45°, 90° | Orientation angle ±60°, 90° |
|---|---|---|---|---|---|
| 3 | 0.51 mm | 2.30 | 1.26 | 0.56 | 0.37 |
| 5 | 0.85 mm | 3.96 | 2.39 | 1.00 | 0.62 |
| 7 | 1.18 mm | 5.63 | 3.52 | 1.44 | 0.87 |

There are no particular limitations placed on the number of fiber reinforced plastic (FRP) layers of which the crown portion is composed. Typically, from 2 to 10 layers are laminated, and it is preferable to laminate from 3 to 7 layers. The balance between the durability and the restitution characteristics can be improved by keeping the number of layers within this range. Further, the laminated layers of fiber reinforced plastic (FRP) are so formed that 50% or more in number of them have reinforcing fibers incorporated therein with a fiber orientation angle of 45 to 90 degrees with respect to the reference direction (direction in which the orientation angle is zero degrees). If a plurality of laminated FRP layers vary in thickness, the mass of the reinforcing fibers in the laminated layers having reinforcing fibers incorporated therein with an orientation angle of 45 to 90 degrees may constitute 50% or more of the mass of the reinforcing fibers in all the laminated layers.

Furthermore, it is preferable that the elastic modulus of the reinforcing fibers to be incorporated in the fiber reinforced plastic (FRP) layers be equal to or less than $35\times10^3$ kgf/mm$^2$. A sufficient durability can thus be assured by keeping the elastic modulus in this range. In Table 2 below, values of the equivalent rigidity of various alloy materials are represented as the ratio to the reference value as described before. The equivalent rigidity of the alloy materials is generally high as compared with that of the laminated composite materials comprising a carbon fiber reinforced plastic material as described above.

Figure 9:
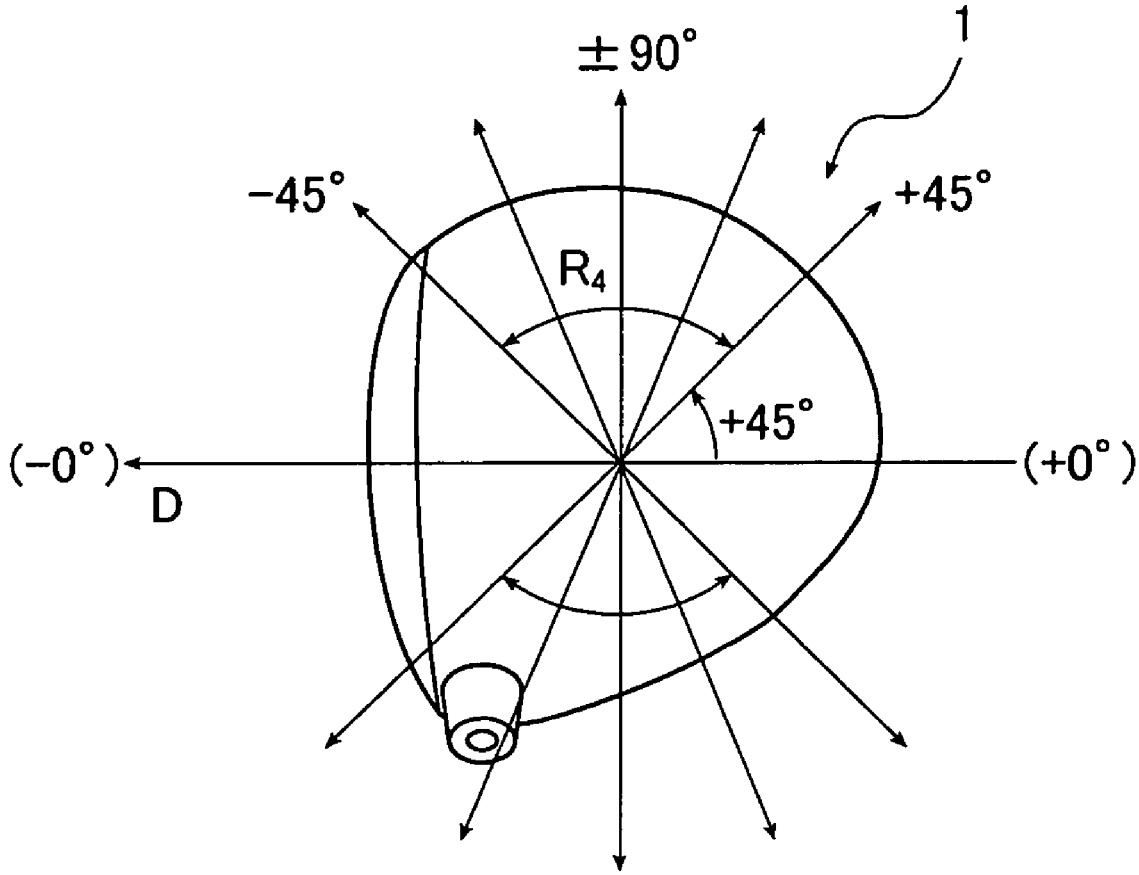
FIG. 9 is a diagram explaining the fiber orientation angle of the crown member of the golf club head.

According to the present invention, at least two of the laminated layers of the crown member have an orientation angle of reinforcing fibers (fiber orientation angle) within a range of 45 to 90 degrees with respect to the direction in which the striking surface of the golf club head is oriented. It should be noted that, as for the above "orientation angle of reinforcing fibers within a range of 45 to 90 degrees", the magnitude of the orientation angle is represented in absolute values. To be more specific, an orientation angle of 45 to 90 degrees is actually within a range of −45 to −90 degrees or a range of +45 to +90 degrees with respect to the direction in which the striking surface is oriented. Preferably, orientation angles of 90 degrees (namely, those of +90 degrees and −90 degrees) are excluded. The balance between the restitution characteristics and the durability can be improved by setting the orientation angle to 45 degrees or over but under 90 degrees. FIG. 9 shows a range $R_4$ of the reinforcing fiber orientation angle in the crown member with respect to the direction D in which the striking surface is oriented. In this invention, the crown member may also be composed of a material in the form of a fabric-like cross prepreg, in which reinforcing fibers incorporated in fiber reinforced plastic layers are oriented in two different directions, that is to say, at two different orientation angles of, for instance, −45 degrees and +45 degrees. In that case, a layer of such material formed should be considered to possess a two-layer structure.

TABLE 2

| Material | Thickness | Equivalent crown rigidity value |
|---|---|---|
| Ti-6-4 alloy | 1 mm | 8.81 |
| SUS | 1 mm | 15.07 |
| Al alloy | 1 mm | 5.32 |
| Mg alloy | 1 mm | 3.37 |

The golf club head main body 60 is an integrally molded member which collectively forms the side portion 21, the sole portion 31 and the hosel portion 51, and is made by, for instance, casting a titanium alloy. As shown in FIG. 1 and FIG. 3, a side face that structures the side portion 21 is provided with a curved shape that bulges to the outside, in conformity with a side surface of a wood type golf club head. On the other hand, an overlap width portion 20*a* that extends from an upper edge of the side portion 21 is provided with a curved shape that bulges to the outside, in conformity with an outer circumferential edge of the crown portion 11. A layer of an adhesive such as an epoxy resin, a urethane resin, an acrylic resin, or a cyanoacrylate resin (not shown) with a thickness of 0.03 to 1.5 mm is formed on an upper surface of the overlap width portion 20*a*. The overlap width portion is bonded to a lower surface of the crown member 10 through the adhesive layer to constitute a joining portion. The layer for bonding may also be prepared by forming a resin film on the overlap width portion 20*a* instead of applying an adhesive. Examples of the resin film which may be formed include a film of a thermoplastic resin such as a polyurethane resin, a nylon resin, a modified nylon resin, a polyethylene terephthalate resin, a polyvinyl chloride resin, a polycarbonate resin, a polyvinylidene chloride resin, an ethyl cellulose resin, and a cellulose acetate resin. Such adhesives and resin films as above can be used in a similar manner to prepare a layer for bonding on an overlap width portion 40*a* as will be described below.

There are no particular limitations placed on the thickness of the side portion 21, provided that the thickness allows the side portion to withstand impacts during ball striking. It is preferable that the thickness of the side portion 21 be typically from 0.5 to 2.0 mm.

As shown in FIG. 1 and FIG. 3, a surface that structures the sole portion 31 is provided with a curved shape that bulges to the outside, in conformity with a bottom surface of a wood type golf club head. There are no particular limitations placed on the thickness of the sole portion 31, provided that the thickness allows the sole portion to withstand impacts during ball striking. It is preferable that the thickness of the sole portion 31 be typically from 1.0 to 3.0 mm.

The face member 40 is formed by trimming a titanium or titanium alloy plate after the contour of the development of the face portion 41 of the golf club head 1, as being accompanied by the overlap width portion 40*a* on its upper edge, and pressing the trimmed plate so as to form the face portion 41 and the overlap width portion 40*a* therein. As shown in FIG. 1 and FIG. 3, a surface that structures the face portion 41 is almost planar, in conformity with the striking surface of a wood type golf club head.

In this embodiment, the face member 40 includes the overlap width portion 40*a*, while the crown member or sole member may also include such a portion. Moreover, it is possible to provide an overlap width portion on part of the periphery of the crown member, for instance, one edge thereof, although the overlap width portions 20*a* and 40*a* to be joined with the crown member extend along the entire periphery of the crown member, as shown in FIG. 2. Even in that case, the restitution characteristics and the durability as described below can be assured in a balanced manner so that such configuration as above is one of the embodiments of the present invention.

The overlap width portion 40*a* that extends from the upper edge of the face portion 41 is provided with a curved shape that bulges to the outside, in conformity with the outer circumference of the crown portion 11. Further, both ends of the overlap width portion 40*a* are formed having shapes that coincide with the shapes of both ends of the overlap width portion 20*a* of the side member 20. The overlap width portion 40*a* thus forms a curved continuous surface together with the overlap width portion 20*a*. A layer of an adhesive such as an epoxy resin, a urethane resin, an acrylic resin, or a cyanoacrylate resin (not shown) is formed on an upper surface of the overlap width portion 40*a* to a thickness of 0.03 to 1.5 mm for the purpose of bonding. The overlap width portion is bonded to the lower surface of the crown member 10 through the adhesive layer to constitute a joining portion. Naturally, the layer for bonding may also be prepared by forming the resin film as described before. A crisp sound can be made when a ball is struck by forming the face portion 41 by using a metal.

No overlap width portions are formed on a lower end side of the face member and in either lateral surface of the face member 40. There are no particular limitations placed on the thickness of the face member 40, provided that the thickness allows the face member to withstand impacts during ball striking. It is preferable that the thickness of the face member 40 be typically from 1.5 to 4.0 mm. A lower edge of the face member 40 and a front surface of the sole portion 31 are formed having shapes that coincide with each other. The lower edge of the face member 40 and the front surface of the sole portion 31 are joined together by welding, for example. Right and left edges of the face member 40, and right and left edges of the side portion 21 of the golf club head main body 60 are formed having shapes that coincide with each other. The left and right edges of the face member 40 and the left and right edges of the side portion 21 are joined together by welding, for example.

It should be noted that the sole portion 31, the side portion 21, and the hosel portion 51 that structure the golf club head main body 60 may also be provided as separate, discrete members. For example, a method may be used in which a single plate of titanium or titanium alloy is trimmed in accordance with a development and pressed so as to form a sole member and a side member. The sole member, the side member, and a separately formed hosel member are integrated with one another by welding boundary portions of the respective members, or by bonding them together through overlap width portions that extend from outer circumferential edges of the respective members.

As shown in FIG. 2, the golf club head 1 is fabricated by bonding the crown member 10 formed of a composite material comprising a carbon fiber reinforced plastic (CFRP) to a golf club head intermediate body 101 formed of titanium or a titanium alloy with an adhesive to join them together.

In the embodiment as described above, the crown member 10 and the sole member 31 are each formed of a single material. It is, however, also possible to form each of them of two or more materials. In this respect, the crown member available for obtaining the equivalent rigidity ratio is a member used in a region of the crown portion 11, which region is located along the connecting edge of the crown portion 11 connecting to the face portion 41 and within a distance of 50 mm from the connecting edge and whose surface area constitutes 5% or more of the total surface area of the crown portion 11. The sole member available for obtaining the equivalent rigidity ratio is a member used in a region of the sole portion, which region is located along the connecting edge of the sole portion connecting to the face portion 41 and within a distance of 50 mm from the connecting edge and whose surface area constitutes 5% or more of the total surface area of the sole portion.

The total surface area of the crown portion is the total surface area of a zone enclosed by the edges of the crown portion connecting to the side portion, the face portion and a neck member, respectively, and such connecting edges can be found out based on the change in radius of curvature in the surface. Similarly, the total surface area of the sole portion is the total surface area of a zone enclosed by the edges of the sole portion connecting to the side portion and the face portion, respectively. If the crown portion is indefinite due to the painting on the outer surface of a golf club head, the golf club head may be decomposed so as to inspect the joining portion from inside and thereby find out the edges of the side portion, the crown portion, and the sole portion. In the case of the crown portion being indefinite, it is also possible to consider the projected area of the golf club head found by looking down on the golf club perpendicularly to the horizontal reference plane when the head is addressed in an ordinary position on the reference plane, with the projected area of the striking surface excluded, as the total surface area of the crown portion.

The crown member as above is described in more detail with reference to the golf club heads as shown in FIGS. 4A and 4B. In this connection, similar definitions are to be given to the sole member.

The crown member of the golf club head as shown in FIG. 4A is formed of a single material such as an alloy and a composite material while that of the golf club head as shown in FIG. 4B is formed of two different materials including an alloy and a composite material.

In the case of the golf club head as shown in FIG. 4A, the crown member available for obtaining the equivalent rigidity ratio according to the present invention is a member used in a region (region $R_1$ shown with hatching) of the crown portion 11, which region is located along the connecting edge E of the crown portion 11 connecting to the face portion 41 and within a distance of 50 mm from the connecting edge and whose surface area constitutes 5% or more of the total surface area of the crown portion 11. In the golf club head as shown in FIG. 4B, layers of two different materials (a layer composed of a titanium alloy as the lower layer and a layer composed of a five-layer laminate of a fiber reinforced plastic material as the upper layer, for instance) are formed in a region $R_2$, while a region $R_3$ is formed of a single material (that is to say, formed by a layer composed of a five-layer laminate of a fiber reinforced plastic material, for instance). In the case of the latter golf club head, the crown member available for obtaining the equivalent rigidity ratio according to the present invention is a member used in a part of the region $R_2$ overlapping with the region of the crown portion 11 located along the connecting edge of the crown portion 11 and within a distance of 50 mm from the connecting edge (region $R_1$ in FIG. 4A) provided that the surface area of the relevant part constitutes 5% or more of the total surface area of the crown portion 11. The member used in a part of the region $R_3$ overlapping with the region $R_1$ is similarly considered as the crown member available for obtaining the equivalent rigidity ratio according to the present invention provided that the surface area of the relevant part constitutes 5% or more of the total surface area of the crown portion 11. In a golf club head having such a crown portion as is shown in FIG. 4B, therefore, a plurality of crown members may be determined as available for obtaining the equivalent rigidity ratio. As for the sole member also, two or more members are so determined in some cases. Under such conditions, the equivalent rigidity ratio of 0.8 or less has only to be achieved with a combination of any one out of the crown members so determined and any one out of the sole members so determined. In other words, in an exemplary case where the crown member composed of fiber reinforced plastic layers, the crown member composed of metal or an alloy, and the crown member composed of laminated layers of a fiber reinforced plastic material and an alloy are so determined as above, the equivalent rigidity of any one of such crown members may give a ratio to that of the sole portion of 0.8 or less.

Figure 10:
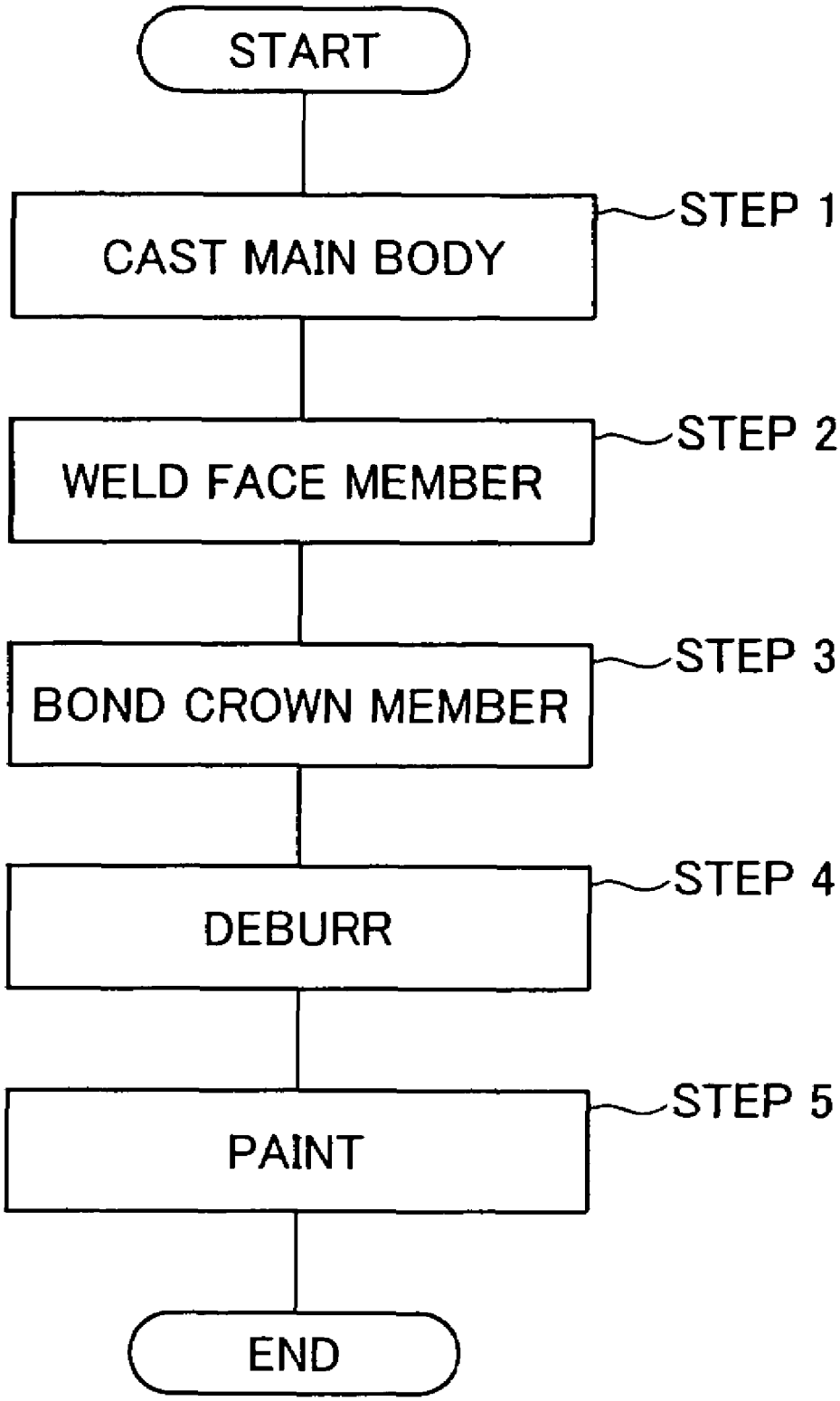
FIG. 10 is a flowchart of a manufacturing process of the golf club head of the present invention.

A method of manufacturing the golf club head 1 according to this embodiment is described next. FIG. 10 is a flowchart that shows a procedure for manufacturing the golf club head 1 according to this embodiment. Upon manufacturing the golf club head 1 according to this embodiment, first the golf club head main body 60, in which the side portion and the sole portion are integrated, is manufactured by casting a titanium alloy, for example Ti-6-4 alloy (step 1). Once the golf club head main body 60 is manufactured, the face member 40 is joined to the face portion 41 of the golf club head main body 60 by welding, for example (step 2). The golf club head intermediate body 101 in which the face member 40 is welded to the golf club head main body 60 can thus be obtained.

The crown member 10 is manufactured in parallel with the manufacture of the golf club head intermediate body 101. A carbon fiber reinforced plastic (CFRP) sheet (hereinafter referred to as "CFRP sheet" or "carbon sheet") is first prepared in order to manufacture the crown member 10. The CFRP sheet is cut into a desired shape with a desired fiber orientation direction. For example, in this embodiment, the sheet is cut into a shape which the crown member 10 will take when developed. From three to seven layers of the CFRP sheet having fiber orientation directions of 45 to 90 degrees, for example, are then laminated, thus obtaining the crown member 10.

Next, the crown member 10 thus formed is set within a die, that is, a die provided with a curved surface corresponding to the final shape of the crown member 10, and cured at a predetermined temperature and a predetermined pressure to bond the member itself (step 3). In this bonding process, the crown member is molded under an internal pressure by maintaining it at 155° C. for 15 minutes while applying an internal pressure of 3 to 8 kg/cm$^2$, for example, and postcured by further maintaining it at a temperature of 135° C. for one hour. A resin that structures the matrix of the CFRP used in forming the crown member 10, such as an epoxy resin, a urethane resin, an acrylic resin, or a cyanoacrylate resin, functions as an adhesive in this embodiment. An unpainted golf club head is thus obtained by the processes described above.

Not only an upper portion of the golf club head 1 can be made lighter, but also the center of gravity of the golf club head 1 can be lowered by forming the crown portion 11 by using a CFRP sheet. Further, by forming the crown portion 11 by using a CFRP sheet to thereby control the elastic modulus of the crown portion 11, various types of golf club heads can be provided which allow modifications of the coefficient of restitution of a struck golf ball. In addition, golf club heads varying in the shape of the crown portion 11, including those having a crown portion with a complex curved surface, can be manufactured easily and at low cost. Furthermore, as discussed hereinafter, golf club heads that are provided with crown portions having high durability, such as impact resistance and environmental resistance, can be provided.

Before bonding the crown member 10 to the golf club head intermediate body 101, it is preferable to perform a surface roughening treatment such as blasting on each surface of the overlap width portions 20*a* and 40*a*, and on the lower surface of the outer circumferential edge of the crown member 10 that is bonded thereto. A joining portion having a high mechanical strength can thus be formed by performing the surface roughening treatment on the surfaces to be joined together.

The adhesives such as epoxy resins, urethane resins, acrylic resins, and cyanoacrylate resins can be given as examples of adhesives used for bonding individual members. It is preferable that the joining portion thus formed by the adhesive, the part of the crown member 10 to be bonded, and the overlap width portions 20*a* and 40*a* be provided with a tensile shear strength equal to or greater than 200 kgf/cm$^2$. It is more preferable that the joining portion has a tensile shear strength equal to or greater than 200 kgf/cm$^2$ after being left to stand for two weeks in an environment with a temperature of 50° C. and a relative humidity of 95%. By forming the joining portion having a high tensile shear strength equal to or greater than 200 kgf/cm$^2$, a golf club head provided with superior durability can be obtained.

For example, a method in which the width of the overlap width portions 20*a* and 40*a* is set to 5 to 20 mm, or the area of the overlap width portions 20*a* and 40*a* is set to 1,500 to 4,500 mm$^2$ can be used to obtain the joining portion provided with such a tensile shear strength as above.

Deburring is performed by using abrasive paper or the like on the golf club head 1 thus formed (step 4). A primer such as nylon is applied before painting is performed according to a predetermined pattern (step 5). The golf club head 1 is thus obtained as such a finished product as is shown in FIG. 3.

The golf club head 1 of this embodiment is provided with a hollow structure, as is clear from FIG. 1. By thus making the golf club head hollow, the golf club head itself can be made lightweight. Further, the golf club head can be easily manufactured by bonding thin plates of metals and composite materials. A member composed of CFRP is used in this embodiment as the crown member 10, and it is preferable to structure the golf club head by using a member composed of fiber reinforced plastic (FRP), which constitutes 4% or more of the golf club head on the basis of mass, and a member composed of a metallic material. Further, each of the members that structure the golf club head may also be formed by using fiber reinforced plastic (FRP) and metal. By using a member composed of FRP at a mass ratio to the head of 4% or more, a larger volume and a smaller weight of the golf club head can be achieved concurrently and the initial ballistic characteristics of a struck golf ball, that is, the initial velocity, the launch angle, the backspin rate, and the like, can be effectively regulated. For such an effective regulation, a mass ratio of 4 to 48% is more preferable.

As described above, the golf club head 1 of the present invention is structured by manufacturing the crown member 10, the golf club head main body 60 comprising the side portion 21, the sole portion 31 and the hosel portion 51, as well as the face member 40 separately from one another and joining them together. The thickness of each member can therefore be selected. Structural portions on which an impact force does not act directly during ball striking, for example the side portion 21 and the sole portion 31, may be molded relatively thin. A larger weight margin can thus be obtained for the golf club head 1 compared to conventional golf club heads that are formed by integral molding, and a wider variation in design is allowed.

On the other hand, the outer circumferential edges of the side portion 21 and the face member 40 are provided with the overlap width portions 20*a* and 40*a*, respectively. An adhesive is applied to the overlap width portions 20*a* and 40*a*. The golf club head intermediate body 101, that comprises the golf club head main body 60 in which the side portion 21, the sole portion 31, and the hosel portion 51 are integrated and the face member 40, is thus joined with the crown member 10 by bonding. The area of the joining portion formed by an adhesive layer (bonding layer) as well as the crown member 10 and the overlap width portions 20*a* and 40*a* between which the bonding layer is sandwiched is larger compared to a join by welding or screwing. Moreover, relatively thin portions exist over the entire joining portion, without the thickness thereof increasing discontinuously. Stress during ball striking can therefore be dispersed, without concentrating. In addition, the adhesive layer itself functions as a buffer material, and therefore the adhesive layer absorbs the impact during ball striking. Consequently, a sufficient mechanical strength can be obtained even though the thickness of the plate materials to be used is reduced.

The golf club head 1 can thus be made lightweight while maintaining its mechanical strength, and therefore the volume of the golf club head can be increased up to 300 to 580 cc, while maintaining its weight almost the same as that of conventional golf club heads, and the area of the sweet spot can be made larger. In addition, although an example is described in this embodiment where the golf club head 1 is made by combining two types of materials, namely titanium or a titanium alloy as a metal, and CFRP as a composite material, the golf club head is not limited to this structure. For example, there may be a plurality of members having the joining portion, and the members to be joined together may be formed of one and the same material, or different materials. Moreover, the crown member, the side member, the sole member, the face member, and the hosel member may be formed by using different materials and joined together by using an adhesive. A wider variation in design is thus allowed by using the members different from one another in material, such as formed of different types of metals, in the individual structure portions, or even a golf club head provided with novel characteristics may be provided.

It should be noted that the above wording "different types of metals" refers to metals different from one another in kind in the case of simple metals. In the case of alloys, any two alloys are considered as different types of metals if the percentage value, which is found by comparing the composition ratios of the metallic elements common to both the alloys between the alloys and summing values of the lower ratios selected between the two composition ratios respectively, is less than 20%. For example, when comparing 6-4 titanium alloy (Ti:Al:V=90:6:4) and 15-5-3 titanium alloy (Ti:Mo:Zr:Al=77:15:5:3), the value of the sum total described above becomes 80% (77+3), and therefore 6-4 titanium alloy and 15-5-3 titanium alloy are not considered as different types of metals.

Joining is performed by bonding members together as described above, and therefore a golf club head in which members that are formed by using different types of metals are joined by an adhesive can be produced. In other words, different types of metals that cannot be joined by welding can be combined in forming the golf club head.

In addition, examples of the composite material which may be used include those selected from the group consisting of fiber reinforced metals (FRMs), in which reinforcing fibers manufactured out of $Al_2O_3$ are dispersed in a matrix manufactured out of a metal, metal matrix composite (MMC) materials, in which a reinforcing material of carbon fibers is dispersed in a matrix manufactured out of a metal, fiber reinforced plastics (FRPs), in which reinforcing fibers manufactured out of an inorganic material are dispersed in a matrix manufactured out of a resin, and ceramic matrix composite (CMC) materials, in which a reinforcing material of SiC fibers is dispersed in a matrix manufactured out of a ceramic.

Materials having various characteristics can thus be combined and used, and therefore a wider variation in design is allowed. That is, using materials having specific properties as appropriate can provide a golf club head that is provided with various types of characteristics regarding the initial ballistic characteristics of a golf ball, the location of the center of mass, and the like. Further, using low cost materials as appropriate restrains an increase in manufacturing cost. In addition, joining of different types of composite materials is performed by using an adhesive, and therefore neither a large molding die like that used in the case of integral molding nor large-scale equipment be necessary. A golf club head capable of being manufactured easily and at low cost can therefore be provided.

EXAMPLES

Examples of the present invention are described below. Test pieces and test heads were prepared by the methods as below. After performing environmental tests, tensile shear tests were performed on the test pieces, and actual striking durability tests were performed on the test heads.

1. Preparation of Test Pieces

Test pieces were prepared by using titanium alloy plates manufactured from Ti-6-4 alloy adapted to golf club heads and having a length of 100 mm and a width of 25.4 mm. An adhesive was applied to each of two plates, specifically in a region from its one end to a point 13 mm away from the end, and the plates were joined together into a test piece. An epoxy adhesive and an acrylic adhesive were used as the adhesive. The test pieces were prepared with (TH01 and TH03) or without (TH02 and TH04) a blasting treatment.

2. Preparation of Test Heads (Golf Club Heads)

Golf club heads such as is shown in FIG. 2 were prepared as test heads. The crown member 10 as shown in FIG. 2 was formed using a CFRP sheet (carbon sheet) and bonded to the golf club head intermediate body 101 separately made of Ti-6-4 alloy so as to prepare such a golf club head as is shown in FIG. 2. An epoxy adhesive and an acrylic adhesive were used for bonding. The test heads were prepared with (TH01-H and TH03-H) or without (TH02-H and TH04-H) a blasting treatment. On the test heads thus prepared were mounted golf club shafts for TR-X DUO M-40 (trade name) golf clubs manufactured by The Yokohama Rubber Co., Ltd. to fabricate golf clubs each having a length of 45 inches.

3. Method of Testing

The test pieces and the golf clubs fabricated as above were exposed to an environment with a temperature of 50° C. and a relative humidity of 95% for zero or two weeks. After that, each golf club was used to strike a golf ball at an initial velocity of 50 m/s so that the ball might impact the face portion of the relevant test head at a point 10 mm above the center of the portion. The number of times the head was impacted by a ball before it was broken was recorded. The maximum number of times of impacting was set to 5,000. The golf balls used were TR-X (trade name) balls manufactured by The Yokohama Rubber Co., Ltd. The test pieces were evaluated by measuring the adhesion strength (tensile shear strength) of each test piece. Results of the two tests are shown in Table 3 and Table 4, respectively.

TABLE 3

Test Head Durability Test Results (Initial Ball Velocity: 50 m/s)

| Test head | Adhesive | Materials bonded | Blasting | Environmental Test Conditions | Durability Test Results 0 weeks | Durability Test Results 2 weeks |
|---|---|---|---|---|---|---|
| TH01-H | Epoxy | Ti-6-4 alloy and carbon sheet | Performed | 50° C., 95% | More than 5,000 | More than 5,000 |
| TH02-H | | | Not performed | | More than 5,000 | More than 5,000 |
| TH03-H | Acrylic | | Performed | | 2,650 To breakage | 2,100 To breakage |
| TH04-H | | | Not performed | | 1,800 To breakage | 1,050 To breakage |

Striking point: 10 mm above the center.

TABLE 4

High Temperature, High Humidity Environment Test Results on Titanium Alloy Plates Made From Ti-6-4 Alloy (50° C., 95%, 0 and 2 weeks)

| Test piece | Adhesive | Materials Bonded | Blasting | Environmental Test Conditions | Tensile Shear Test Results 0 weeks | Tensile Shear Test Results 2 weeks |
|---|---|---|---|---|---|---|
| TH01 | Epoxy | Ti-6-4 alloy and | Performed | 50° C., 95% | 310.5 | 293.1 |
| TH02 | | | Not performed | | 239.8 | 215.9 |

TABLE 4-continued

High Temperature, High Humidity Environment Test Results on Titanium Alloy Plates Made From Ti-6-4 Alloy (50° C., 95%, 0 and 2 weeks)

| Test | Materials | | | Environmental | Tensile Shear Test Results | |
|---|---|---|---|---|---|---|
| piece | Adhesive | Bonded | Blasting | Test Conditions | 0 weeks | 2 weeks |
| TH03 | Acrylic | Ti-6-4 | Performed | | 176.1 | 147.6 |
| TH04 | | alloy | Not performed | | 121.4 | 106.2 |

As can be understood from the results set forth in Table 3, the test heads TH01-H and TH02-H, in which bonding of the crown member formed of a CFRP sheet (carbon sheet) was carried out by the application of an epoxy adhesive, showed no change even after 5,000 hits and thus proved superior in durability. On the other hand, in the case of the test heads TH03-H and TH04-H, in which bonding of the crown member formed of a CFRP sheet was carried out by the application of an acrylic adhesive, the CFRP sheet peeled before 3,000 hits so that these heads were found to have insufficient mechanical strength.

Further, as can be understood from the results set forth in Table 4, the test pieces TH01 and TH02 were provided with a tensile shear strength equal to or greater than 200 kgf/cm$^2$. It was found that the test pieces TH03 and TH04 had a tensile shear strength that is less than 200 kgf/cm$^2$. It, however, was demonstrated that the test pieces TH02 and TH04, on which blasting was not performed, have environmental test values that tend to be poor relatively to those of the test pieces TH01, TH03 and TH04, on which blasting was performed. It thus proved that it is preferable to perform blasting.

(Exemplary Experiment)

An experiment described hereinafter was performed in order to verify effects of the bonding of the crown member 10, formed by using any one out of various materials, to the golf club head intermediate body 101. That is, eight test heads (test golf club heads) varying in the material used to form the crown member 10, the orientation angle of reinforcing fibers in the composite material used to form the crown member 10, and the method of joining the crown member to the golf club head intermediate body 101 were prepared. On the test golf club heads thus prepared were mounted golf club shafts for TR-X DUO M-40 (trade name) golf clubs manufactured by The Yokohama Rubber Co., Ltd. to fabricate golf clubs each having a length of 45 inches. The rigidity value, the restitution characteristics, and the durability of each of the test golf club heads were investigated. The golf balls used in the tests were TR-X (trade name) balls manufactured by The Yokohama Rubber Co., Ltd.

Eight types of golf club heads, CH01 to CH05 and FH01 to FH03, were prepared as the test golf club heads. The materials used to form the crown members of the individual test golf club heads CH01 to CH05 and FH01 to FH03, the orientation angles of reinforcing fibers in the composite materials for the crown members, the rigidity values, the methods of joining the crown member to the golf club head intermediate body, results of restitution tests, and results of durability tests are all shown in Table 5.

The orientation angle of the reinforcing fibers was set on the assumption that the orientation angle was zero in the back-to-face direction (direction in which the striking surface was oriented or the struck golf ball made its way) and 90 degrees in the toe-to-heel direction (direction parallel to the surface of the face portion). Further, with the crown members of Example 1 to Example 4, orientation angles of 45 to 90 degrees with respect to the direction in which the striking surface was oriented were imparted to one-half or more of all the plies of laminated carbon sheet. Furthermore, the elastic modulus of the carbon fibers in carbon sheets was $24\times10^3$ kgf/mm$^2$, and the thickness of the carbon fibers was 0.173 mm. In the table, the symbol "CFRP" denotes a carbon fiber reinforced plastic, and the symbol "AFRP" denotes an aramid fiber reinforced plastic in which aramid fibers are incorporated as reinforcing fibers. Results shown in Table 5 were obtained when performing the tests described above. The restitution characteristics and the durability are each more excellent as their indexes set forth in Table 5 are larger.

TABLE 5

| Experiment name | Test head | Member bonded | Forming material | Orientation angle | Equivalent crown rigidity/equivalent sole rigidity | Joining Method | Restitution characteristics | Durability |
|---|---|---|---|---|---|---|---|---|
| Comparative example 1 | FH01 | Crown member | Ti alloy | — | 1.00 | Welding | 100 | 100 |
| Example 1 | CH01 | | CFRP | +45° for 2 plies, −45° for 2 plies | 0.11 | Bonding | 116 | 106 |
| Example 2 | CH02 | | CFRP | 0° for 3 plies, 90° for 3 plies | 0.64 | Bonding | 108 | 102 |
| Example 3 | CH03 | | CFRP | +30° for 1 ply, −30° for 1 ply, +45° for 1 ply, −45° for 1 ply | 0.21 | Bonding | 112 | 104 |
| Example 4 | CH04 | | AFRP | 0° for 3 plies, 90° for 3 plies | 0.32 | Bonding | 113 | 104 |
| Example 5 | CH05 | | Mg alloy | — | 0.74 | Bonding | 109 | 100 |
| Comparative example 2 | FH02 | | CFRP | 0° for 4 plies, 90° for 2 plies | 0.90 | Bonding | 102 | 101 |

TABLE 5-continued

| Experiment name | Test head | Member Forming bonded material | Orientation angle | Equivalent crown rigidity/equivalent sole rigidity | Joining Method | Restitution characteristics | Durability |
|---|---|---|---|---|---|---|---|
| Comparative example 3 | FH03 | CFRP | +45° for 2 plies, −45° for 2 plies | 0.11 | Screwing | 114 | 91 |

As is clear from the results set forth in Table 5, when Example 1 to Example 5 (CH01 to CH05) and Comparative Example 1 (FH01) were compared, the restitution characteristics and the durability of Examples 1 to 5, in which bonding with an adhesive was used as the method of joining the crown member and the golf club head intermediate body together, were both superior to those of Comparative Example 1, in which welding was used as the joining method. Thus, the balance between the restitution characteristics and the durability was good. The equivalent rigidity ratio (equivalent crown rigidity/equivalent sole rigidity) was less than 0.8 in each of Examples 1 to 5. In Comparative Example 2, where the orientation angle of the reinforcing fibers was set to zero and 90 degrees, the equivalent rigidity ratio was 0.90, which was higher than that of any of Examples 1 to 5, and only a restitution characteristics and a durability which were as low as those of Comparative Example 1 were obtained. In the case of Comparative Example 3, where screwing was used as the joining method, the durability dropped remarkably, although the equivalent rigidity ratio was 0.11 and the restitution characteristics were improved as compared with Comparative Example 1. Moreover, Examples 1 and 3 each having no reinforcing fibers therein whose orientation angle was 90 degrees were superior to Example 2 having reinforcing fibers therein whose orientation angle was 90 degrees in both the restitution characteristics and the durability.

In addition, when looking at the results for Examples 1 to 4, it is clear that the restitution characteristics and the durability were both high and there was good balance between the restitution characteristics and the durability when 50% or more in number of the laminated layers of fiber reinforced sheet had a reinforcing fiber orientation angle of 45 to 90 degrees with respect to the direction in which the striking surface was oriented. The restitution characteristics tests were performed under a ball speed condition of 160 ft/s. The durability tests were performed under a ball speed condition of 50 m/s, and the striking point was 10 mm above the center of the face portion.

The golf club head and the golf club of this invention have specifically been described. The present invention, however, is in no way limited to the above Examples and it is naturally possible to make various modifications and changes without departing from the scope of the present invention.

INDUSTRIAL APPLICABILITY

According to the present invention, the golf club head having high standards of restitution characteristics and durability, with good balance between the restitution characteristics and the durability, can be provided.

What is claimed is:

1. A golf club head comprising outer shell structure portions including a hosel portion, a face portion, a sole portion, a crown portion, and a side portion; and a joining portion where a crown member used in the crown portion is bonded to a member used in another outer shell structure portion, wherein:

the crown member is formed of a fiber reinforced material and the member used in said another outer shell structure portion is formed of a metal, and the crown member has an equivalent rigidity not more than 0.8 times as high as that of a sole member used in the sole portion, the equivalent rigidity of a member used in each portion defined as a product of a thickness of the relevant member and an elastic modulus of the member in a direction in which a golf ball-striking surface of the face portion is oriented.

2. The golf club head according to claim 1, wherein the fiber reinforced material used for the crown member is either a reinforced metal (FRM) or a fiber reinforced plastic (FRP).

3. The golf club head according to claim 1, wherein the crown member is composed of a plurality of laminated layers of a fiber reinforced material, of which layers two or more have a fiber orientation angle of 45 to 90 degrees with respect to a direction in which a golf ball-striking surface of the face portion is oriented, and a mass of reinforcing fibers in the layers having a fiber orientation angle of 45 to 90 degrees with respect to the direction in which the striking surface is oriented constitutes 50 percent or more of a mass of reinforcing fibers in all the laminated layers and a thickness of the crown member is from 0.3 to 2 mm, and the member used in said another outer shell structure portion is formed of a metal.

4. The golf club head according to claim 3, wherein said two or more layers having a fiber orientation angle of 45 to 90 degrees with respect to a direction in which the striking surface is oriented constitute crossover layers in which reinforcing fibers are slanted from a direction in which the striking surface is oriented to a direction different from one layer to another.

5. A golf club head comprising outer shell structure portions including a hosel portion, a face portion, a sole portion, a crown portion, and a side portion; and a joining portion where a crown member used in the crown portion is bonded to a member used in another outer shell structure portion, wherein:

the crown member is composed of a plurality of laminated layers of a fiber reinforced material, of which layers two or more have a fiber orientation angle of 45 to 90 degrees with respect to a direction in which a golf ball-striking surface of the face portion is oriented, and the number of the layers having a fiber orientation angle of 45 to 90 degrees with respect to the direction in which the striking surface is oriented constitutes 50 percent or more of the total number of the laminated layers and a thickness of the crown member is from 0.3 to 2 mm, and the member used in said another outer shell structure portion is formed of a metal.

6. The golf club head according to claim 5, wherein said crown member has an equivalent rigidity not more than 0.8 times as high as that of a sole member used in said sole portion, the equivalent rigidity of a member used in each portion defined as a product of a thickness of the relevant member and an elastic modulus of the member in the direction in which the golf ball-striking surface of said face portion is oriented.

7. The golf club head according to claim 5, wherein said crown member is formed of either a fiber reinforced metal (FRM) or a fiber reinforced plastic (FRP).

8. The golf club head according to claim 5, wherein said two or more layers having a fiber orientation angle of 45 to 90 degrees with respect to a direction in which the striking surface is oriented constitute crossover layers in which reinforcing fibers are slanted from a direction in which the striking surface is oriented to a direction different from one layer to another.

9. A golf club head comprising outer shell structure portions including a hosel portion, a face portion, a sole portion, a crown portion, and a side portion; and a joining portion where a crown member used in the crown portion is bonded to a member used in another outer shell structure portion, wherein:

the crown member is composed of a plurality of laminated layers of a fiber reinforced material, of which layers two or more have a fiber orientation angle of 45 to 90 degrees with respect to a direction in which a golf ball-striking surface of the face portion is oriented, and the crown member has an equivalent rigidity not more than 0.8 times as high as that of a sole member used in the sole portion, the equivalent rigidity of a member used in each portion defined as a product of a thickness of the relevant member and an elastic modulus of the member in the direction in which the golf ball-striking surface of the face portion is oriented, and the member used in said another outer shell structure portion is formed of a metal.

10. A golf club having a golf club head, a golf club shaft, and a grip, wherein:

the golf club head comprises outer shell structure portions including a hosel portion, a face portion, a sole portion, a crown portion, and a side portion; and a joining portion where a crown member used in the crown portion is bonded to a member used in another outer shell structure portion; and the crown member is composed of a plurality of laminated layers of a fiber reinforced material, of which layers two or more have a fiber orientation angle of 45 to 90 degrees with respect to a direction in which a golf ball-striking surface of the face portion is oriented, and the number of the layers having a fiber orientation angle of 45 to 90 degrees with respect to the direction in which the striking surface is oriented constitutes 50 percent or more of the total number of the laminated layers and a thickness of the crown member is from 0.3 to 2 mm, and the member used in said another outer shell structure portion is formed of a metal.

11. The golf club according to claim 10, wherein a mass of reinforcing fibers in the layers having a fiber orientation angle of 45 to 90 degrees with respect to the direction in which the striking surface is oriented constitutes 50 percent or more of a mass of reinforcing fibers in all the laminated layers.

* * * * *